US006601650B2

(12) United States Patent
Sundararajan

(10) Patent No.: US 6,601,650 B2
(45) Date of Patent: Aug. 5, 2003

(54) METHOD AND APPARATUS FOR REPLACING BOP WITH GATE VALVE

(75) Inventor: Alagarsamy Sundararajan, Katy, TX (US)

(73) Assignee: Worldwide Oilfield Machine, Inc., Houston, TX (US)

( * ) Notice: Subject to any disclaimer, the term of this patent is extended or adjusted under 35 U.S.C. 154(b) by 0 days.

(21) Appl. No.: 09/992,220

(22) Filed: Nov. 6, 2001

(65) Prior Publication Data

US 2003/0029619 A1 Feb. 13, 2003

Related U.S. Application Data

(63) Continuation-in-part of application No. 09/925,676, filed on Aug. 9, 2001.
(60) Provisional application No. 60/318,371, filed on Sep. 10, 2001.

(51) Int. Cl.[7] ..... E21B 29/00
(52) U.S. Cl. ..... 166/361; 166/55; 166/86.3; 166/376

(58) Field of Search ..... 166/373, 376, 166/383, 86.3, 91.1, 55, 55.1, 55.2, 361

(56) References Cited

U.S. PATENT DOCUMENTS

| | | | | |
|---|---|---|---|---|
| 4,215,749 A | * | 8/1980 | Dare et al. | 166/361 |
| 4,886,115 A | | 12/1989 | Leggett et al. | 166/77 |
| 5,269,340 A | | 12/1993 | Drzewiecki | 177/318 |
| 5,501,424 A | * | 3/1996 | Williams et al. | 251/1.3 |
| 5,803,431 A | * | 9/1998 | Hoang et al. | 251/327 |
| 5,894,771 A | * | 4/1999 | Braun et al. | 82/47 |
| 5,938,175 A | | 8/1999 | Young et al. | 251/329 |

* cited by examiner

*Primary Examiner*—William Neuder
(74) *Attorney, Agent, or Firm*—Kenneth L. Nash

(57) ABSTRACT

The present invention discloses apparatus and methods for replacing a BOP with a gate valve to thereby save space, initial costs, and maintenance costs that is especially beneficial for use in offshore subsea riser packages. The method provides a gate valve capable of reliably cutting tubing utilizing a cutting edge with an inclined surface that wedges the cut portion of the tubing out of the gave valve body. A method and apparatus is provided for determining the actuator force needed to cut the particular size tubing.

19 Claims, 4 Drawing Sheets

METHOD AND APPARATUS FOR REPLACING BOP WITH GATE VALVE

This application claims benefit of U.S. Provisional Application No. 60/318,371 filed Sep. 10, 2001, and is a continuation-in-part of U.S. patent application Ser. No. 09/925,676 filed Aug. 9, 2001.

BACKGROUND OF THE INVENTION

1. Field of the Invention

The present invention relates generally to gate valves and, more particularly, to a large I.D. gate valve with a cutter operable for repeatable cutting pipe and/or wireline so as to be especially suitable for replacing an entire BOP stack in a lower riser package.

2. Description of the Background

Blowout Preventor (B.O.P.) stacks are frequently utilized in oilfield wellbore Christmas trees such as, for instance, lower riser packages in offshore wells. B.O.P. stacks may include a first set of rams for sealing off the wellbore and a second set of rams for cutting pipe such as tubing and/or cutting wireline. However, B.O.P. stacks tend to be quite bulky and heavy, which are undesirable features especially in lower riser packages for undersea operation where space is often at a premium. B.O.P. stacks tend to be expensive for initial installation. Moreover, if maintenance is required, then the maintenance costs for replacing such B.O.P. stacks can be many times the original installation costs. B.O.P. stacks may frequently require maintenance after cutting pipe is required. For instance, the cut pipe may become stuck within the B.O.P. stack blocking other operations.

While gate valves with various types of cutters have been developed including gate valves with one or more cutting edges for cutting wireline, such gate valves have not been utilized to replace B.O.P. stacks. Moreover, it would be desirable to provide a gate valve for casing such as in the 7⅜ inch range operable for cutting production tubing such as, for instance, 2⅞ inch production tubing with 0.204 wall thickness.

Consequently, those skilled in the art will appreciate the present invention that addresses the above problems.

SUMMARY OF THE INVENTION

An objective of the present invention is to provide an improved gate valve with capability of reliably and repeatable cutting tubulars of at least 2¾" or more, if desired, without the need for maintenance.

Another objective of the present invention is to provide a large diameter gate valve suitable for replacing a B.O.P. stack containing rams for sealing the wellbore and rams for cutting tubing.

Accordingly, the present invention provides a method for a gate valve mountable onto a wellbore casing. The gate valve is preferably operable for controlling fluid and cutting tubing. The method may comprise one or more steps such as, for instance, mounting the gate valve on the well casing for controlling fluid flow without also utilizing a BOP on the well casing, mounting a slidable gate within the gate valve, providing the slidable gate may have a first side and a second side opposite the first side, providing first and second seats for the slidable gate such that the first side of the gate is preferably adjacent the first seat and the second side of the gate is preferably adjacent the second seat, providing a single cutting edge on the slidable gate of the gate valve such that the slidable gate defines an aperture through the slidable gate, positioning the single cutting edge such that the aperture has a minimum diameter at the cutting edge, forming the cutting edge adjacent the first side of the gate, and/or providing an inclined surface on the gate such that the inclined surface defines at least a portion of the aperture such that the aperture increases in diameter with respect to axial distance away from the cutting edge such that the aperture has a maximum diameter towards an opposite side of the gate.

Other steps may comprise mounting the gate valve in a subsea installation. In one embodiment the method may further comprise providing that the first seat is preferably formed by telescoping interconnecting two seat elements with respect to each other, providing that the second seat is preferably formed by telescoping interconnecting two seat elements with respect to each other, and/or providing that the aperture has a minimum diameter at the first side of the slidable gate.

In another embodiment, a method is provided for determining force needed on a gate to cut a tubular disposed within a gate valve. The gate valve is preferably mountable on a wellbore casing such that the tubular is preferably positional within the wellbore casing. The method may comprise one or more steps such as, for instance, providing a test body for slidably supporting a test gate, the test gate may comprise dimensions related to the gate, inserting a test pipe through the test body and the test gate, the test pipe may comprise dimension related to the tubular, applying force to the test gate until the pipe is cut by the test gate, and measuring the force on the test gate required for cutting the test pipe. The method may also comprise designing an actuator for the gate such that the actuator is capable of producing the force and/or utilizing a hydraulic press for applying the force to the test gate.

In another embodiment, a method is provided for cutting a pipe within a wellbore utilizing a gate valve such that the pipe is pushed away from a gate within the gate valve. The method may comprise one or more steps such as, for instance, providing the gate valve with a single cutting edge on one side of the gate along the aperture through the gate, providing an inclined surface on the aperture through the gate such that the aperture opens to a maximum diameter distal the single cutting edge, inserting the pipe into the wellbore through the gate valve, closing the gate within the gate valve, and cutting the pipe as the gate closes such that the inclined surface produces a force on the pipe to move the pipe away from the gate.

Therefore an apparatus is provided comprising a gate valve for a subsea riser package installation the subsea riser package installation may have no B.O.P. The apparatus comprises one or more elements such as, for instance, a sliding gate within the gate valve, a single cutting edge mounted on one side of the sliding gate, an inclined surface adjacent the cutting edge such that the single cutting edge and the inclined surface define an aperture through the sliding gate, and a hydraulic actuator for the gate valve operable to apply sufficient force to the sliding gate to cut the tubular. In one embodiment, the inclined surface is angled with respect to an axis through the aperture and flow path of the gate valve by from three degrees to twenty degrees.

Figure 1:
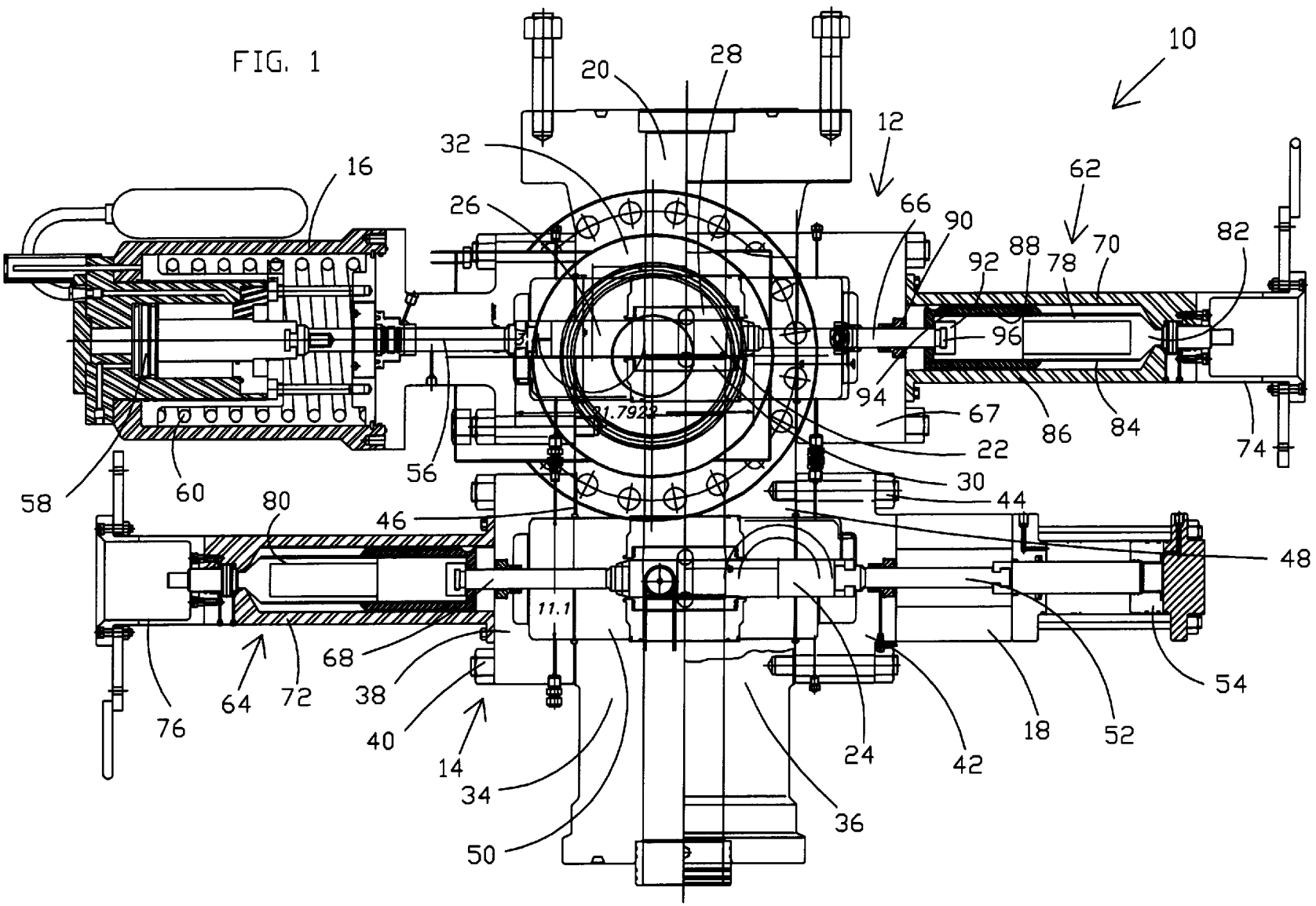
FIG. 1 is an elevational view, partially in section, of a subsea valve assembly in accord with the present invention.

While the present invention will be described in connection with presently preferred embodiments, it will be understood that it is not intended to limit the invention to those embodiments. On the contrary, it is intended to cover all alternatives, modifications, and equivalents included within the spirit of the invention and as defined in the appended claims.

BRIEF DESCRIPTION OF THE PREFERRED EMBODIMENTS

Referring now to the drawings, and more particularly to the figure, there is shown a subsea valve assembly 10, in accord with the present invention. Due to the physical space limitations, it is desirable that subsea valve assembly 10 be as compact as possible.

Subsea valve assembly 10 may include one or more gate valves, such as gate valve 12 and gate valve 14. Various types of hydraulic gate valve actuators may be utilized within subsea valve assembly 10, such as fail-safe gate valve actuator 16 and hydraulic actuator 18. An exemplary embodiment of a fail-safe gate valve actuator is disclosed in U.S. patent application Ser. No. 09/802,209, filed Mar. 8, 2001, referenced hereinbefore, and incorporated herein by reference. Gate valves 12 and 14 are utilized to control fluid flow through conduit 20 which is part of a subsea installation. Subsea valve assembly 10 shown in the FIG. 1 is of a type that may be utilized in very deep water.

Gate valve 12 comprises a slidable gate 22 and gate valve 14 comprises a slidable gate 24. Gates 22 and 24 are each individually moveable between an open position and a closed position whereby fluid flow through conduit 20 may be controlled. Gate 22 includes passageway 26 therethrough such that in the position shown gate 22 is in the closed position. Seat elements 28 and 30 work with gate 22 for sealing and opening passageway 20. Likewise, gate 24 is shown in the open position to thereby permit fluid flow through passageway 20. In many cases, it may be desirable to include both a hydraulic actuator gate valve and a failsafe hydraulic actuator for ensuring that fluid flow through conduit 20 is properly controlled if hydraulic power is lost.

Gate valve 12 includes gate valve housing 32 and gate valve 14 includes gate valve housing 34. The gate valve housings may be constructed in different ways. However, a preferred embodiment of the present invention provides for a gate valve housing comprised of a gate valve body which is symmetrical on both sides for attachment to two gate valve bonnets. Thus gate valve housing 34 comprises gate valve body 36 which includes a first gate valve bonnet 38 secured by connectors such as stud/nut assemblies 40 to gate valve body 36. Gate valve housing 34 also includes a second gate valve bonnet 42 which is secured by stud/nut assemblies 44 to gate valve body 36. In this presently preferred embodiment, gate valve body 36 is substantially symmetrical on each side such that either gate valve bonnet may attach to either symmetrical side 46 or symmetrical side 48 of gate valve body 36. While not required, this symmetrical construction permits significant flexibility of design whereby hydraulic actuators and/or manual override operators, as discussed subsequently, may be positioned as desired on whichever side of the gate valve most suitable for the particular dimensional requirements.

The gate valve housings include a chamber defined therein in which the gate moves. Thus, gate valve housing 34 defines chamber 50 in which gate 24 moves translationally between the open and closed position in response to action of hydraulic actuator 18. Gate 24 is controlled by hydraulic actuator 18 by means of operating stem 52. Piston 54 is hydraulically activated to control operating stem 52 which in turn controls the position of gate 24. Likewise, failsafe actuator 16 connects to operating stem 56 and operates as described in detail in my above referenced previous patent application in response to hydraulic activation of piston 58 and/or control spring 60. Usually, a failsafe valve is either a normally open valve or a normally closed valve, depending on the requirement, such that if failure occurs then the valve returns to the desired position.

In general, it will be understood that such terms as "up," "down," "vertical," and the like, are made with reference to the drawings and/or the earth and that the devices may not be arranged in such positions at all times depending on variations in operation, transportation, mounting, and the like. As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quicker understanding or explanation of the invention. One of skill in the art upon reviewing this specification will understand that the relative size and shape of the components may be greatly different from that shown and the invention can still operate in accord with the novel principals taught herein.

Valve system 10 preferably also utilizes manual override operators such as manual override operators 62 and 64 which operate in conjunction with fail-safe hydraulic actuator 16 and hydraulic actuator 18, respectively. Each manual override operator is preferably mounted to one of the two gate valve bonnets. Thus, manual override operator 64 is mounted to gate valve bonnet 38. Manual overrride operator 62 is mounted to gate valve bonnet 67 preferably in the same manner as discussed previously. Because the opposing bonnets, such as bonnets 38 and 42 may be connected to either of the opposite sides 46 and 48 of gate valve body 36, the respective manual override operator and actuator, such as manual override actuator 64 and hydraulic actuator 18 may be positioned on either side of valve body 36. In this way, the flexibility of subsea valve system 10 is significantly enhanced and provides significant flexibility of design.

Manual override operators 62 and 64 are therefore mounted on an opposite side of the gate valve with respect to the hydraulic actuator. By this placement in accord with the present invention, the overall size of valve system 10 is greatly reduced. My prior application shows mounting an exemplary compact manual override operator onto an actuator. In this application, my invention provides a manual override operator that is not directly connected to the actuator but is instead positioned on an opposite side of the gate valve as shown in FIG. 1. By positioning the manual override operator in this manner, it will be understood by those of skill in the art that space is much more efficiently utilized. This is especially true for a preferred subsea valve system 10 construction which may require the valve housing be positioned at a center position for controlling flow through a conduit, such as conduit 20, and having only a limited amount on either side of conduit 20.

Preferably, manual override operator 62 and 64 operate in the same manner as other possible override operators that may be mounted directly to a respective actuator. The present invention permits such operation by utilizing reverse cut threads and by utilizing a balance stem. Thus, gate valve 12 also comprises balance stem 66 and gate valve 14 comprises balance stem 68. Balance stems generally have the additional purpose of providing pressure balancing for deep water operation.

Balance stem 66 connects to an opposite side of gate 22 from operator stem 56. Likewise balance stem 68 connects to an opposite side of gate 24 as compared to operator stem 52. Preferred connections to the gate that provide additional features such as seals and so forth are discussed in my previous application.

While various constructions of manual override operators may be provided, in the present embodiment the manual override operator comprises a manual override housing such as housing 70 or 72. A rotatable element, which may be activated either by divers or by remotely operated vehicles (ROV), such as rotatable element 74 or 76 is provided. Rotatable element 74, for instance, is utilized to rotate manual override shaft 78. Rotatable element 76 may likewise rotate manual override shaft 80.

Since the two manual override operators are substantially the same, the present discussion will cover manual override operator 62 and it will be understood that manual override 64 operates in a similar manner. Rotary connector 82 is utilized to rotatably secure manual override shaft 78 within manual override housing 70 such that manual override shaft 78 is rotatable with respect to manual override housing 70 but preferably is prevented from translational and/or longitudinal movement within manual override housing 70. Manual override shaft 78 has a threaded portion 84 along an outer periphery of override drive shaft 78. The threads of threaded portion 84 mate with corresponding threads of threaded portion 88 on an inner side of override slave member 86. Thus, override slave member 86 is threadably connected to manual rotary shaft 78 and is prevented from rotation as discussed subsequently but is free to move translationally or along its axis. Therefore, override slave member 86 reciprocates or moves translationally or along its longitudinal axis when manual override rotary drive shaft 78 is rotated. Preferably the threads of threaded portion 84 and the corresponding mating threads of threaded portion 88 are reverse cut or left-handed threads. Thus, it will now be appreciated by those of skill in the art that rotational operation of manual override operator 62 will be exactly the same as if the manual override operator were located on the actuator as occurs in the prior art. While this embodiment shows threads on an outer surface of threaded portion 84 of rotary drive shaft 78 and on the inner surface of threaded portion 88 of override slave member 86, it will be understood that other mechanical constructions could also be utilized whereupon the end result is that rotation of operator 74 will result in translational movement of balance stem 66 and, accordingly, gate 22. Thus, if manual operation of gate valve 12 and/or gate valve 14 is desired or required, the corresponding manual override operator can be utilized for this purpose.

Override slave member 86 engages balance stem 66 which slidably extends through opening 90 in the gate valve bonnet 67. As override slave member 86 moves translationally or along its axis, then gate 22 also moves translationally or along its axis. If a manual override is not desired, then a closed bonnet can be installed and/or a suitable plug may be secured to bonnet 67. For deepwater applications, a balance stem may preferably be desirable regardless of whether a manual override operator in accord with the present invention is utilized and a housing of some type such as manual override housing may be utilized. While various types of connectors may be utilized for attaching override slave member 86 to balance stem 66, a preferred embodiment utilizes inserts to connect to the T-slot end 96 of balance stem 66 is utilized. The inserts may be released by pins, retractable elements, or the like (not shown).

In this embodiment of the invention, one or more rib/slot connections, such as rib/slot connection 94, may be utilized to prevent rotation of manual override slave member 86 to thereby require manual override slave member 86 to move translationally as manual override drive shaft 78 is rotated. In this particular embodiment, the rib is mounted to manual override housing 70 and the mating slot is formed on override slave member 86. However, this construction could be reversed and/or other means to effect the same mechanical operation could be utilized.

If desired, various types of indicators may be utilized to indicate the position of the manual override operator and/or the position of the actuator. My previous application discusses a few of such indicators including highly compact position indicators.

Thus, when assembling valve assembly 10, the operator has wide flexibility of where to position the manual override operator as well as where to position the hydraulic actuators. In the embodiment shown, the manual override operators are positioned on opposite sides of the gate valves from the hydraulic operators. Since the valve body is symmetrical, the position of the manual override operator and hydraulic actuator can be reversed if necessary to fit the desired dimensional requirements. If necessary, the manual override operator could also be positioned on the actuator as described in my previous application. Therefore, it will be understood that the present invention provides considerable flexibility of operation.

To operate the manual override operator in accord with the present invention, element 74 may be rotated by a diver or ROV in a manner well known in the prior art. Since the threaded portions 88 and 84 comprise reverse cut or left-handed threads, the operation is exactly the same as if standard or right-handed threads were utilized and the manual override assembly were mounted directly to the actuator an exemplary example of which is shown in my previous application. However, instead of pushing the gate to the desired position through the operating stem, the action involves pulling the gate to the desired position by means of balance stem 66. Rotation of element 74 results in rotation of override drive shaft 78, which is rotatably mounted but is prevented from translational movement along its axis. Rotation of override drive shaft causes rotation of threaded portion 84 which in turn causes translational movement of manual override slave member 86. Manual override slave member 86 cannot rotate but can move translationally along its axis. Since manual override slave member 86 is connected to balance stem 66 by means of inserts 92 and T-slot connector 96, balance stem 66 must move in response to movement of override slave member 86. In turn, gate 22 is secured to balance stem 66 and must move in response thereto.

Gate valve cutter 100 could be used for either gate valve, such as gate valve 12 or gate valve 14 disclosed in valve system 10. Gate valve cutter 100 may be used in many other circumstances such as for large diameter valves wherein it is desirable to provide means for reliably cutting tubing. It would be highly desirable to be able to eliminate the high initial costs and even higher maintenance costs of BOP stacks. Gate valve 10 of the present invention provides the ability to eliminate BOB stacks with a large diameter gate valve that can seal off the wellbore as well as repeatedly cut pipe or wireline with reduced or no need for maintenance.

Figure 2:
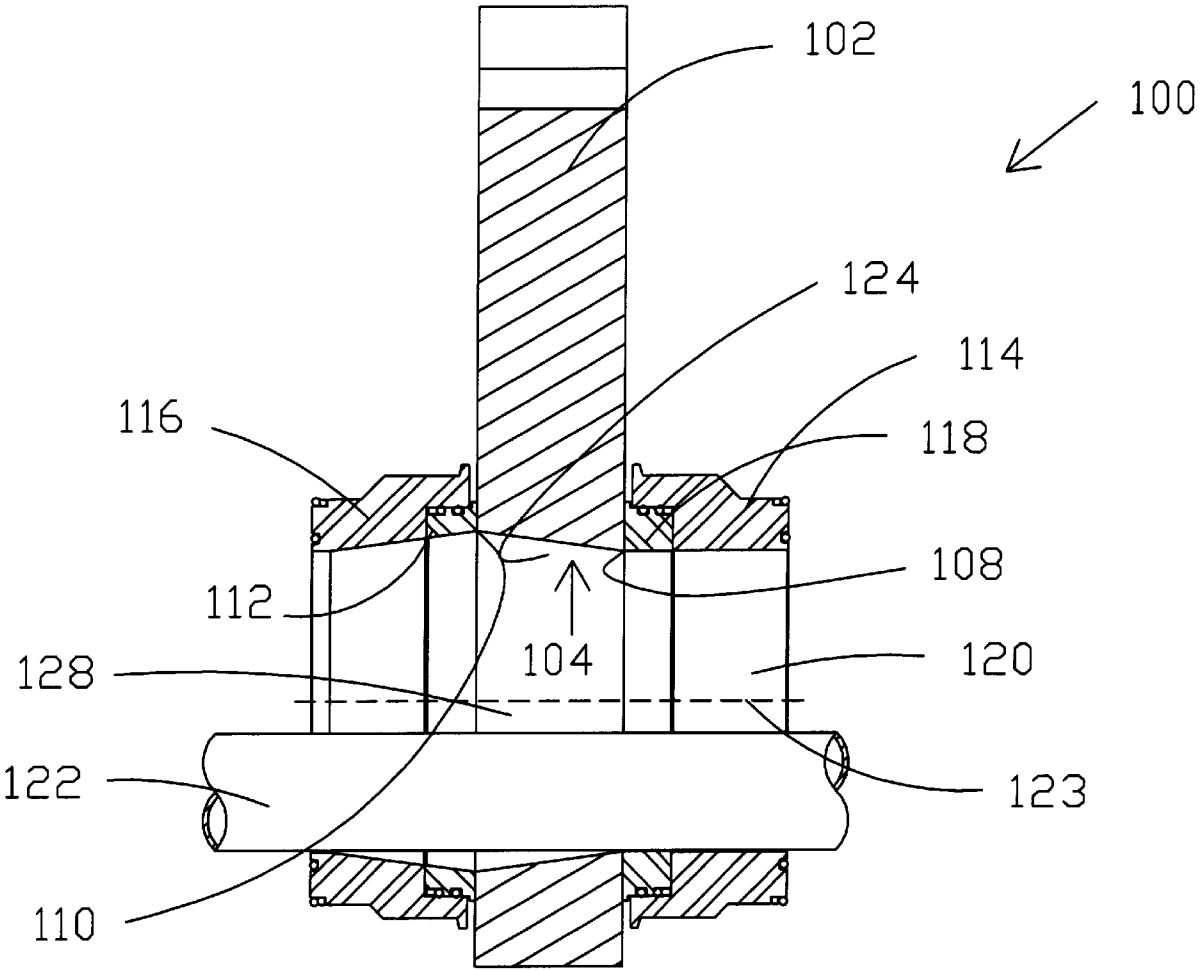
FIG. 2 is an elevational view, partially in section, of a hydraulically operated subsea gate valve that may be utilized as either gate valve in the subsea valve assembly of FIG. 1.

FIG. 2 shows gate valve 100 for 7⅜ inch casing having 2⅞ inch production tubing extending therethrough. Gate valve 100 may be used for larger diameter bores such as wellbores with tubing therein. Such bores are generally greater than about 4½ inches although the embodiment disclosed herein is for 7⅜ inch casing. Gate element 102 is designed to have a blade 104 with initial cutting surface 106 having a minimum gate aperture 128 diameter directly adjacent seat 108. The maximum diameter of gate aperture 128 defined by blade 104 is preferably at the opposite side of blade 104 at 110 directly adjacent seat 112. Thus, the blade opens up to provide volume opposite surface 106. This volume and the inclined sloping surface 124 actually pushes the tubing 122 out of the path of gate element 10 as gate element 102 closes the valve thereby decreasing the likelihood of jamming the valve element or preventing the valve element from operating. Inclined sloping surface 124 is angled with respect to axial line 123 through flow path 120. The line may slope with straight line variation or the angle of the slope with respect to axial line 123 of inclined sloping surface 124 may vary with axial length. The angle with respect to axial line 123 may vary from a rather small angle of a part of one degree up to about 30 degrees, although a more preferred range may be from about three degrees up to about fifteen degrees.

Preferably the diameter of aperture 128 is at a maximum on the edge of the gate at 110 and at a minimum on the other edge at 106. However, it is conceivable that the maximum and minimums of aperture 128 would not be at the very edges of gate 102. For instance the maximum may be adjacent the edge 110 but not at the edge. If desired, aperture 128 could have an axially constant diameter portion or slightly increase or decrease in diameter.

In a presently preferred embodiment, gate 100 is used with a telescoping gate seat assemblies which include outer retainers 114 and 116 which are mounted in the valve housings such as gate valve housings 32 and 34 in FIG. 1. Telescoping seal assemblies 114, 118 and 112, 116 are mounted in surrounding relationship to flow path 120. Each seal assembly comprises elements such as 114 and 118 which are telescopingly moveable with respect to each other and also each axially moveable with respect to the valve housing such that the overall length of the telescoping seat assembly can lengthen and shorten by a small amount. The amount of axial movement of telescoping seat elements, such as elements 114 and 118, is limited in both directions. However, telescoping seal assembly 114, 118 is, in a presently preferred embodiment, different from telescoping seal assembly 112, 116. Telescoping seal assembly 112, 116 has a larger diameter aperture adjacent gate 102 and also may have an interal slope, incline, cone, along an internal surface of the elements 112, 116 which decreases until it reaches the bore size of aperture 120 which, in a preferred embodiment is equal to internal diameter size of elements 114, 118. In a preferred embodiment, 114, 118 have a constant internal diameter.

Figure 3:
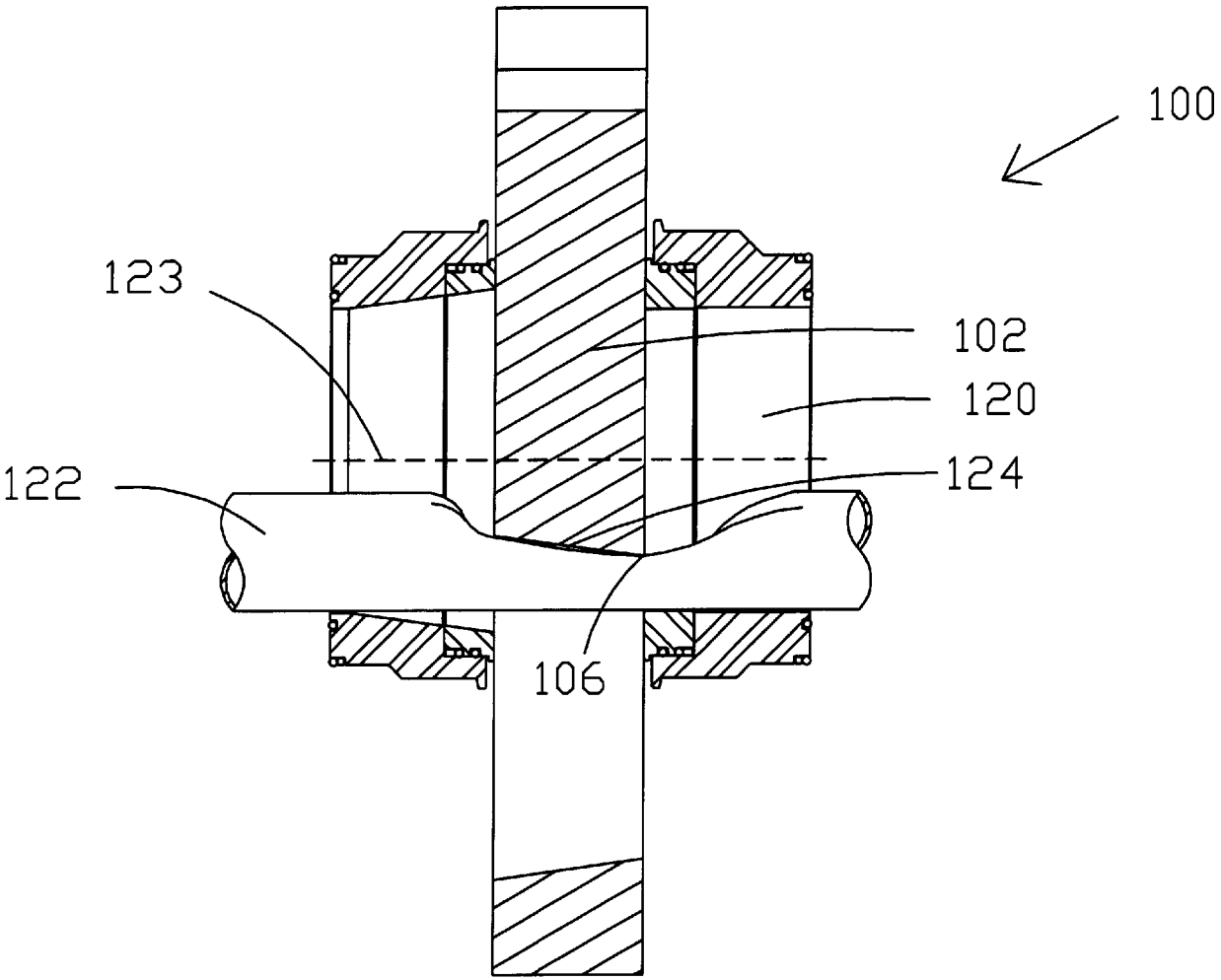
FIG. 3 is an elevational view, partially in section, of the gate valve of FIG. 2 in the process of cutting tubing.

In accord with the present invention, gate element 102 may be utilized not only for sealing off and opening flow path 120, but also for cutting tubular 122. As shown in FIG. 3, when valve 100 is closed such that gate element 102 moves in the direction of sealing off flow path 120, then cutting edge 106 engages, crushes, and cuts pipe 106. As pipe 106 is being cut, the sloping or inclined edge 124 of the gate valve acts to push the pipe 106 out of valve 100. Therefore, unlike many other cutting devices such as BOP's, pipe 106 is not stuck in the valve. If desired, pipe 106 can be pulled during cutting such as toward the left direction as shown in FIG. 3, or not. In any event, due to the design of cutting edge 106 and inclined edge 124, the present invention may be reliably utilized for cutting tubing and/or wireline. Moreover, the process is very reliable. Thus, the process can be repeated as often as desired with little or no need for maintenance as is normally required each time for B.O.P. tubing cutters.

Figure 4:
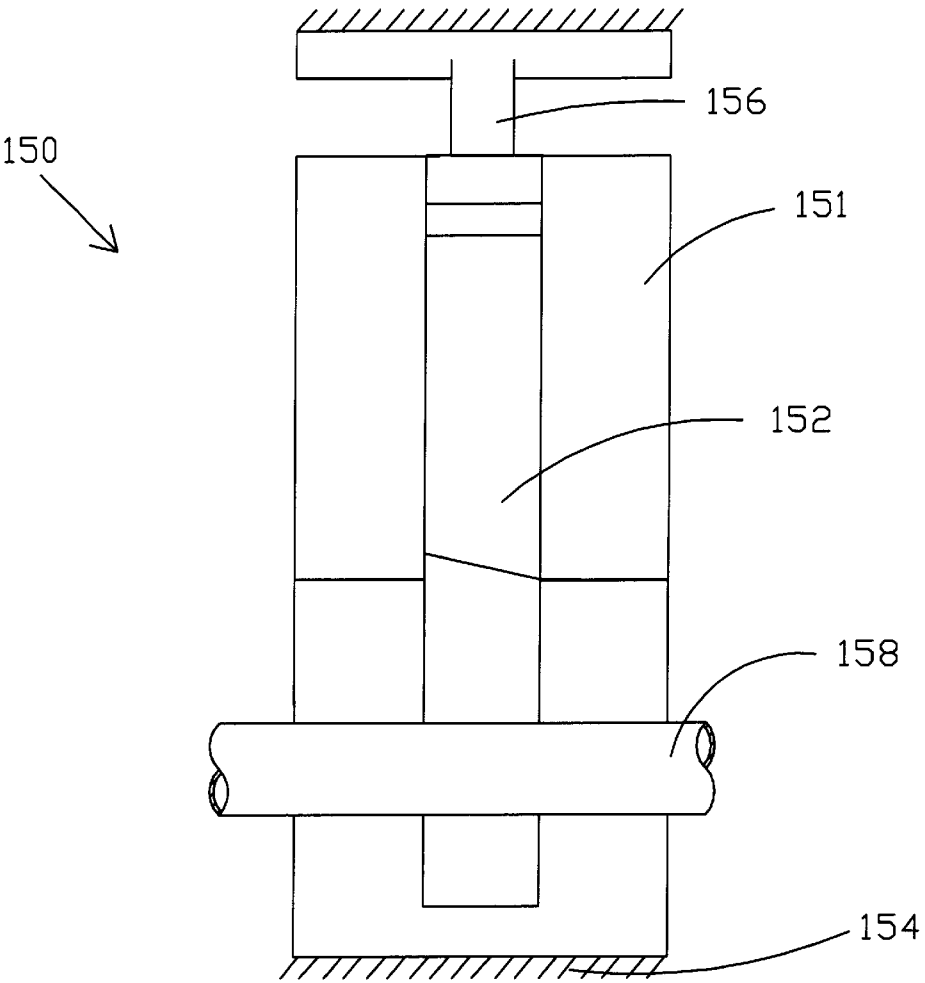
FIG. 4 is a schematic showing an assembly for determining the required hydraulic pressure applied to the gate for a gate valve for cutting tubing in accord with the present invention.

FIG. 4 discloses an apparatus and method for determining the pressure on gate 102 required for cutting the desired size of pipe. Gate 102 has the same dimension as test gate 152. Tubing 158 has the same dimensions as tubing 122. It is difficult to calculate the required force on gate 102 to cut tubing 122 due to the many variables involved. Given the number of variables involved in such calculations, the preferred method of determining the amount of pressure or force on gate 152 is best made empirically by utilizing test system 150. Thus, test housing 151 slidably engages gate 152 by providing an aperture of the same general type as the gate valve housing would support gate 102. Test housing is also suitably supported by some means such as the earth 154 to thereby provide a suitable mounting against which large forces may be applied such as in a machine shop. Hydraulic press 156 or other suitable means may then be utilized to apply a known, measurable, and selected amount of force or pressure to gate 152 until pipe 158 is cut. The process can be repeated as desired until an amount of force or pressure is determined that is assured of reliably cutting the pipe. Moreover, it can be verified that the system operates well and reliably. Valves such as gate valves 12 and 14 utilize hydraulic operators that can then be designed to provide the force required for cutting. Operation of the hydraulic operators is known in the prior art and operation of an exemplary hydraulic fail safe operator, such as fail-safe operator 16, is discussed in some detail in my previous application.

It will be noted that directions, e.g., "up", "down", "left", "vertical", and so forth, are used in this specification only for convenience of understanding with respect to the figures and that the actuators/valves may be oriented in various ways which will not affect reliable operation of the present invention so that such directions as used are not intended to be limiting in any way. While the present invention preferably illustrates the invention in terms of subsea valves, the same principles of operation could be used in other valves such as surface valves, hydrocarbon well christmas trees, valves used in place on B.O.P.'s while drilling, and so forth. For subsea valves, it will also be understood that depending on the water depth, suitable modifications may be made to offset water depth pressure. Moreover, different seals and/or relief valves and so forth may be used in the valve system such as in the valve bonnet, manual override housing, actuator housing, and the like. Moreover, a housing for an actuator, valve, or the like may include various portions or components that may or may not comprise part of another housing used for another purpose and so a housing is simply construed as a container for certain components, for example an actuator housing is a container or body for actuator components, that may be constructed in many ways and may or may not also comprise a housing of a different type such as a valve housing.

While the present invention is described in terms of a subsea valve system especially suitable for a lower riser package, the valve system of the present invention may be utilized in surface valve systems, pipelines, and any other applications, if desired.

The foregoing disclosure and description of the invention is illustrative and explanatory thereof, and it will be appreciated by those skilled in the art, that various changes in the size, shape and materials as well as in the details of the illustrated construction or combinations of features of the various coring elements may be made without departing from the spirit of the invention.

What is claimed is:

1. A method for a gate valve mountable onto a wellbore casing, said gate valve being operable for controlling fluid and cutting tubing, comprising:

mounting said gate valve on aid well casing for controlling fluid flow in place of at least one BOP on said well casing;

mounting a slidable gate within said gate valve, said slidable gate having a first side and a second side opposite said first side;

providing first and second seats for said slidable gate;

positioning said slidable gate between said first and second seats such that said first side of said gate is adjacent said first seat d said second side of said gate is adjacent said second seat;

providing that said first and second seats each have different internal diameters adjacent said slidable gate;

forming an aperture through said slidable gate;

providing a cutting edge on said slidable gate of said gate valve within said aperture such that said cutting edge defines at least a portion of said aperture.

2. The method of claim 1, further comprising:

mounting said gate valve in a subsea installation.

3. The method of claim 1, further comprising:

providing that said first seat is formed by telescoping interconnecting two seat elements with respect to each other, and providing that said second seat is formed by telescoping interconnecting two seat elements with respect to each other.

4. The method of claim 1, further comprising:

providing that said aperture has a minimum size at said first side of said slidable gate.

5. The method of claim 1, further comprising:

providing a single inclined space defining aperture which is angled with respect to an axis through said aperture from about three degrees to about twenty-five degrees.

6. A method for determining force needed on a gate to cut a tubular disposed within a gate valve, said gate valve being mountable on a wellbore casing such that said tubular is positional within said wellbore casing, said method comprising:

providing a test body for slidably supporting a test gate, said test gate comprising dimensions related to said gate;

inserting a test pipe through said test body and said test gate, said test pipe comprising a dimension related to said tubular;

applying force to said test gate until said pipe is cut by said test gate; and measuring said force on said test gate required for cutting said test pipe by sliding movement of said gate.

7. The method of claim 6, further comprising:

designing an actuator for said gate such that said actuator is capable of producing said force.

8. The method of claim 6, further comprising:

utilizing a hydraulic press which is not utilized for controlling a gate valve for applying said force to said test gate.

9. A method for cutting a pipe within a wellbore utilizing a gate valve such that said pipe is pushed away from a gate within said gate valve, said gate defining an aperture therethrough, said method comprising:

providing said gate valve with a cutting edge on one side of said gate along said aperture through the gate;

providing a single inclined surface on said aperture through said gate such that said aperture opens from a minimum size adjacent said cutting edge to a maximum size distal said cutting edge, said single inclined surface extending from said minimum size to said maximum size of said aperture;

inserting said pipe into said wellbore through said gate valve;

closing said gate within said gate valve; and cutting said pipe as said gate closes such that said inclined surface produces a force on said pipe to move said pipe away from said gate.

10. The method of claim 9, further comprises:

determining said force for cutting said pipe utilizing a hydraulic press prior to said step of cutting, wherein said hydraulic press of a type not utilized for controlling a valve for said wellbore.

11. The method of claim 9, further comprising:

mounting said gate within said valve between a first set of telescopingly interconnected seat elements and a second set of telescopingly interconnected seat elements.

12. The method of claim 9, further comprising:

utilizing said gate valve on a wellbore without using a B.O.P.

13. The method of claim 9, further comprising:

providing that said inclined surface is angled with respect to an axis through said aperture of said gate within said gate valve in a range of from three degrees to twenty-five degrees.

14. A gate valve for a subsea riser package installation, said gate valve comprising a valve body defining a flow passageway therethough, said gate valve being operable for cutting a tubular extending through said gate valve and said subsea riser package, said subsea riser package installation being operable for replacement of a B.O.P, said subsea riser package being connectable to a wellbore casing, said subsea river package installation further comprising:

a sliding gate within said gate valve;

a cutting edge mounted on one side of said sliding gate;

an inclined surface adjacent said cutting edge such that said cutting edge and said inclined surface define at least a portion of aperture through said sliding gate;

a hydraulic actuator for said gate valve operable to apply sufficient force to said sliding gate to cut said tubular; and a first seat on a first side of aid sliding gate and a second seat on a second side of said sliding gate, at least one of said first seat of said second seat defining an interior passageway with an axial seat length wherein said interior passageway comprises a conical surface extending along a substantial portion of said axial sea length.

15. The gate valve of claim 14, further comprising:

a first telescopingly interconnected set of at least two seating elements mounted adjacent said one side of said sliding gate, each of said first telescopingly interconnected set of at least two seating elements being moveable within said valve body with respect to said valve body; and a second telescopingly interconnected set of seating elements mounted adjacent an opposite side of said sliding gate.

16. The gate valve of claim 14, wherein said inclined surface is angled with respect to an axis through said aperture by from three degrees to twenty degrees.

17. A gate valve for a subsea riser package installation, said gate valve comprising a valve body defining a flow passageway therethough, said subsea riser package being sized for carrying a tubular therein having a diameter greater an two and one-half inches, said subsea riser package being connectable to a wellbore casing, said subsea riser package installation further comprising:

a sliding gate within said gate valve;

a cutting edge mounted on said sliding gate;

an inclined surface adjacent said cutting edge such that said cutting edge and said inclined surface define at least a portion of aperture through said sliding gate;

a hydraulic actuator for said gate valve operable to apply sufficient force to said sliding gate to cut through said diameter greater than two and one-half inches of said tubular;

a first telescopingly interconnected set of at least two seating elements mounted adjacent said one side of said sliding gate, each of said first telescopingly interconnected set of at least two seating elements being moveable within said valve body with respect to said valve body; and a second telescopingly interconnected set of seating elements mounted adjacent an opposite side of said sliding gate.

18. A gate valve for a subsea riser package installation, said gate valve comprising a valve body defining a flow passageway therethough, said subsea riser package being sized for carrying a tubular therein having a diameter greater an two and one-half inches, said subsea riser package being connectable to a wellbore casing, said subsea riser package installation further comprising:

a sliding gate within said gate valve mounted for transverse movement with respect to said flow passageway;

a cutting edge mounted on said sliding gate;

a first inclined surface adjacent said cutting edge such that said cutting edge and said first inclined surface define at least a portion of an aperture through said sliding gate;

a hydraulic actuator for said gate valve operable to apply sufficient force to said sliding gate to cut through said diameter of said tubular; and a valve seat adjacent said sliding gate, said valve seat having an axial seat length, said valve seat defining an interior wall with second inclined inner surface, said second inclined surface defining an inner diameter which decreases with respect to axial distance away from said sliding gate.

19. The gate valve of claim 18, wherein said second inclined inner surface extends along at least a substantial portion of said axial seat at length.

* * * * *

UNITED STATES PATENT AND TRADEMARK OFFICE

CERTIFICATE OF CORRECTION

PATENT NO. : 6,601,650 B2
DATED : August 5, 2003
INVENTOR(S) : Alagarsamy Sundararajan It is certified that error appears in the above-identified patent and that said Letters Patent is hereby corrected as shown below:

Column 9,
Line 12, delete "aid" and replace with -- said --.
Line 21, delete "d" and replace with -- and --.
Line 42, delete "space" and replace with -- surface --.

Column 10,
Line 38, delete "therethough" and replace with -- therethrough --.
Line 43, delete "river" and replace with -- riser --.
Line 48, insert -- an -- between "of" and "aperture".
Line 52, delete "aid" and replace with -- said --.
Line 54, delete the second "of" and replace with -- or --.

Column 11,
Line 9, delete "therethough" and replace with -- therethrough --.
Line 11, delete "an" and replace with -- than --.

Column 12,
Line 3, delete "therethough" and replace with -- therethrough --.
Line 5, delete "an" and replace with -- than --.
Line 26, delete "at".

Signed and Sealed this

Thirtieth Day of December, 2003

JAMES E. ROGAN
*Director of the United States Patent and Trademark Office*